US006487888B1

(12) United States Patent
Baulier et al.

(10) Patent No.: US 6,487,888 B1
(45) Date of Patent: Dec. 3, 2002

(54) HEMMING MACHINE

(75) Inventors: Dominique Baulier, Windsor (CA); Darius Gheorghita, Belle River (CA)

(73) Assignee: Valiant Corporation (CA)

( * ) Notice: Subject to any disclaimer, the term of this patent is extended or adjusted under 35 U.S.C. 154(b) by 0 days.

(21) Appl. No.: 09/679,677

(22) Filed: Oct. 5, 2000

(51) Int. Cl.[7] ..... B21D 7/06

(52) U.S. Cl. ..... 72/418; 72/323; 72/384; 72/453.01; 72/453.06; 72/453.13; 100/269.02; 100/269.03; 100/269.04

(58) Field of Search ..... 72/312, 323, 384, 72/418, 453.01, 453.02, 453.06, 453.07, 453.13; 100/269.01, 269.02, 269.03, 269.04, 270

(56) References Cited

U.S. PATENT DOCUMENTS

| | | | | |
|---|---|---|---|---|
| 3,376,808 A | | 4/1968 | Beckett et al. | 100/53 |
| 5,038,598 A | * | 8/1991 | Pitzer | 72/453.1 |
| 5,408,858 A | * | 4/1995 | Fukuda | 72/453.13 |
| 5,454,261 A | * | 10/1995 | Campian | 72/384 |
| 5,740,691 A | * | 4/1998 | Kovarovic et al. | 72/323 |
| 6,029,493 A | * | 2/2000 | Maier et al. | 72/312 |
| 6,098,440 A | | 8/2000 | Gorgen | 72/312 |

FOREIGN PATENT DOCUMENTS

EP 0 911 093 A1 4/1999

* cited by examiner

*Primary Examiner*—Ed Tolan
(74) *Attorney, Agent, or Firm*—Gifford, Krass, Groh, Sprinkle, Anderson & Citkowski, P.C.

(57) ABSTRACT

A hemming machine is disclosed having a base, a nest adapted to support a part to be hemmed, a nest carrier which supports the nest and in which both the nest and nest carrier are vertically movably mounted to the base. At least one hemming die is laterally slidably mounted to the base and movable between an extended position in which the die overlies a portion of the nest, and a retracted position in which the die is spaced laterally outwardly from the nest. A lock unit selectively locks the nest carrier against vertical movement relative to the base in at least one, and preferably two positions, so that, with the nest carrier locked against movement relative to the base, inflation of a hydraulic bladder sandwiched between the nest and nest carrier displaces the nest vertically upwardly from the carrier so that the part carried by the nest is compressed against the hemming dies and performs the hemming operation. Preferably, a single drive shaft not only displaces the nest and nest carrier, but also powers the hydraulic circuit to inflate the bladder and thus upwardly displace the nest relative to the nest carrier with an amplified force required to achieve the final flattening of the hem.

16 Claims, 3 Drawing Sheets

HEMMING MACHINE

BACKGROUND OF THE INVENTION

I. Field of the Invention

The present invention relates generally to sheet metal hemming machines.

II. Description of Related Art

There are many previously known hemming machines. Many industries, such as the automotive industry, utilize sheet metal hemming machines to secure two metal parts together. These sheet metal hemming machines typically comprise a base having a nest vertically slidably mounted relative to the base. The nest, in turn, supports the part to be hemmed.

At least one, and typically three to five hemming die sets are laterally slidably mounted to the base and movable between an extended position and a retracted position. In the extended position, the die overlaps the nest so that vertical displacement of the nest toward the hemming die causes the part to be hemmed to be compressed upon the die thus forming the hem. Typically, a prehem is first formed by a prehem die to bend the sheet metal at an angle of approximately 45° while a final hem die retrorsely flattens the sheet metal hem together.

In order to form the hem, the part to be hemmed is first positioned on the nest and, with the hemming dies retracted, the nest is moved to a position just below the prehem die and clearing the part flange to be hemmed. The prehem die set is then moved to an extended position after which the nest is displaced vertically upwardly against the prehem die and retracted after having reached the nominal hemming pressure. The hemming dies are then moved to a retracted position and the nest is moved to a position just below the final hem die. The final hem die is then moved to an extended position and the nest is vertically displaced against the final hem die to complete the hem and also retracted after having reached the final hem pressure. The dies are then moved to their retracted position and the finished part is removed from the nest.

These previously known hemming machines have all suffered from a number of disadvantages. One disadvantage is that the previously known hemming machines have required the use of multiple hydraulic actuators to vertically displace the nest due to the massive weight of the nest. Such actuating means are expensive, hard to maintain and polluting.

Derivated from the previously already known machines, a first generation of electric hemmer has been developed by simply replacing the hydraulic cylinders by one or more linear ball screws powered by electronically synchronized drives.

But to face the double constraint of high production rate and high hemming pressure force, these drive configurations are generally oversized to be able to move quickly for a prehem to a final hem position in high speed, and then to deliver a high torque in static. Such oversizing (×4; ×6) is not only expensive, but presents a real risk for the tooling in case of jamming or other incidental event, by introducing a tremendous reverse inertia to the system.

SUMMARY OF THE PRESENT INVENTION

The present invention provides a hemming machine which overcomes all of the above-mentioned disadvantages of the previously known devices.

In brief, the hemming machine of the present invention comprises a base which is fixed to a ground support surface. Both a nest and nest carrier are vertically slidably mounted to the base with the nest carrier positioned beneath the nest. In the conventional fashion, the nest is adapted to support the part to be hemmed.

Similarly, in the conventional fashion, at least one, and more typically three to five sets of dies, are laterally slidably mounted to the base between an extended and a retracted position. In their extended position, the dies overlie the nest and thus the part to be hemmed. Conversely, in their retracted position, the dies are laterally spaced from the nest to permit free vertical movement of the nest past the dies as well as the part loading/unloading. One die set typically performs the prehem while the other die forms the final hem.

The nest carrier and nest are vertically movably mounted not only relative to the base, but also relative to each other. In order to displace the nest relative to the nest carrier, at least one hydraulic driven bladder is sandwiched in between the nest and the nest carrier while a lock unit selectively locks the nest carrier against downward movement. Thus, with the nest carrier locked against vertical movement, inflation of the driven bladder vertically displaces the nest upwardly relative to the nest carrier.

In order to selectively inflate and deflate the driven bladder, at least one drive bladder is sandwiched in between a piston and the nest carrier. This driven bladder is fluidly connected to the drive bladders by fluid conduits. Thus, with the nest carrier locked against downward vertical movement, movement of the piston toward the nest carrier compresses the drive bladders thus pumping hydraulic fluid contained within the drive bladders from the drive bladders and to the driven bladders. This in turn vertically displaces the nest upwardly relative to the nest carrier so that, with the hemming dies in their extended position, the part to be hemmed is compressed against the hemming dies in the desired fashion.

In the preferred embodiment of the invention, a single rotary shaft is rotatably mounted to the base and extends through an opening in the nest carrier and threadably engages the piston. The piston in turn abuts against a lower surface of the nest carrier. Thus, with the lock unit in its retracted position thus permitting free vertical movement of the nest carrier relative to the base, rotation of the shaft vertically moves the nest and nest carrier in unison with each other in order to position an upper surface of the nest beneath either the prehem or final die. With the nest so positioned, one or more lock units engage the nest carrier to prevent further downward movement of the nest carrier. Thereafter, rotation of the shaft in the opposite direction draws the piston downwardly away from the nest carrier thus compressing the drive bladders. Compression of the drive bladders, in turn, pumps fluid from the drive bladders to the driven bladders thus vertically displacing the nest upwardly and compressing the part to be hemmed against the die set.

The surface ratio between each kind of bladder (driven/drive bladder) is such that the force developed by the drive is amplified by a factor of 4 to 8.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
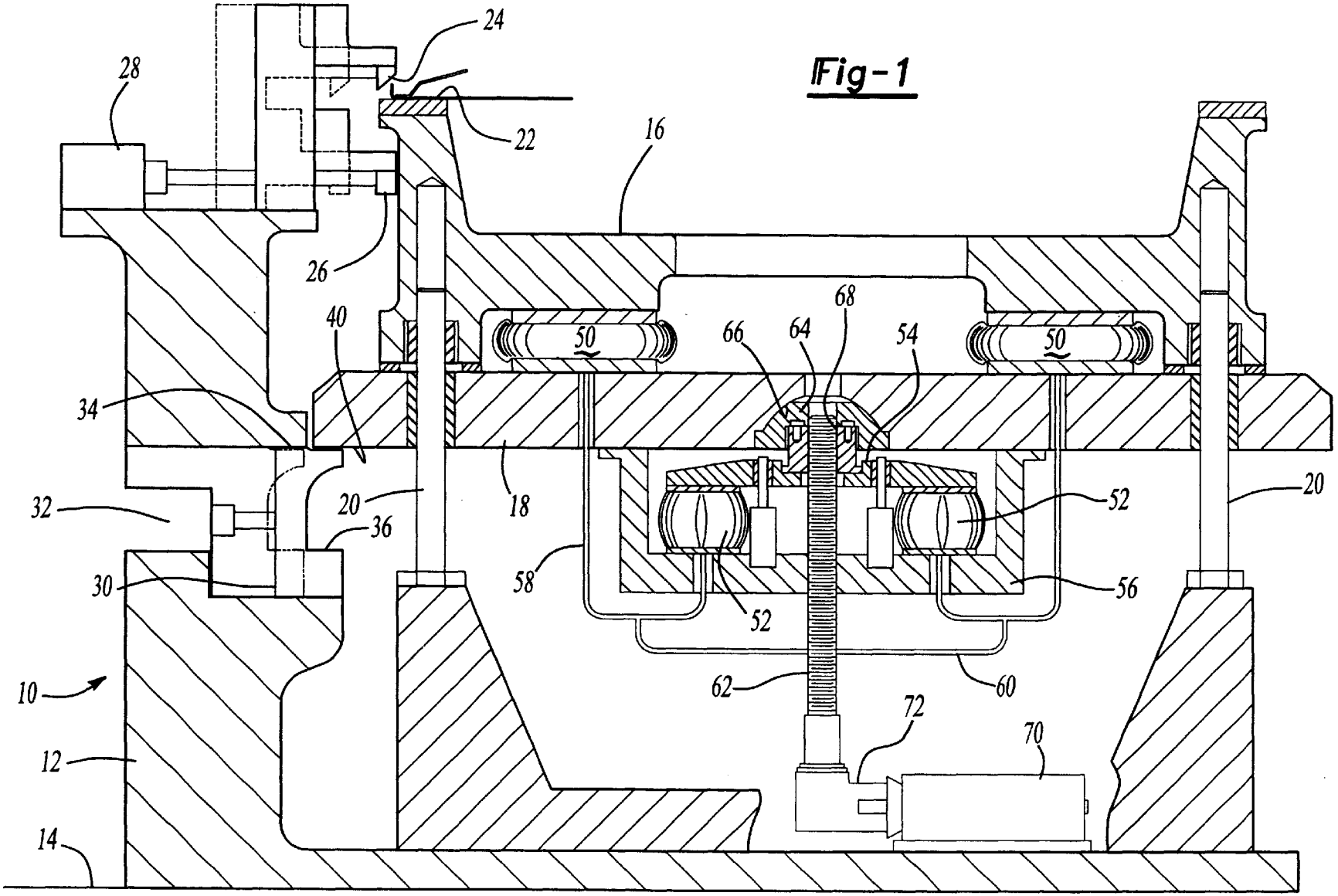
FIG. 1 is a cross-sectional view illustrating a preferred embodiment of the present invention at the initial stage of the prehem position.

With reference first to FIG. 1, a preferred embodiment of the hemming machine 10 of the present invention is there shown and comprises a stationary base 12 supported by a ground surface 14. A nest 16 and nest carrier 18 are vertically slidably mounted to the base 12 by vertical slides 20 which may be of any conventional construction. In the initial stage of prehem position illustrated in FIG. 1, the nest 16 is positioned above and supported by the nest carrier 18. Furthermore, the part to be hemmed is supported by an upper surface 22 of the nest 16 in the conventional fashion.

At least one, and more typically three to five sets of hemming dies 24 and 26 are laterally slidably mounted to the base 12 between an extended position, illustrated in solid line in FIG. 1, and a retracted position, illustrated in phantom line in FIG. 1. Any conventional means, such as an electric or pneumatic cylinder 28, is utilized to move the set of dies 24 and 26 between their extended position and their retracted position.

Still referring to FIG. 1, with the set of dies 24 and 26 in their extended position, the dies 24 or 26 overlie the upper surface 22 of the nest 16 and thus the part to be hemmed. Conversely, with the dies 24 and 26 in their retracted position the nest 16 may be vertically displaced without interference with the dies 24 and 26. Typically, one die 24 is utilized to produce the prehem typically at 45° on the part while the other die 26 performs the final hem.

Figure 3:
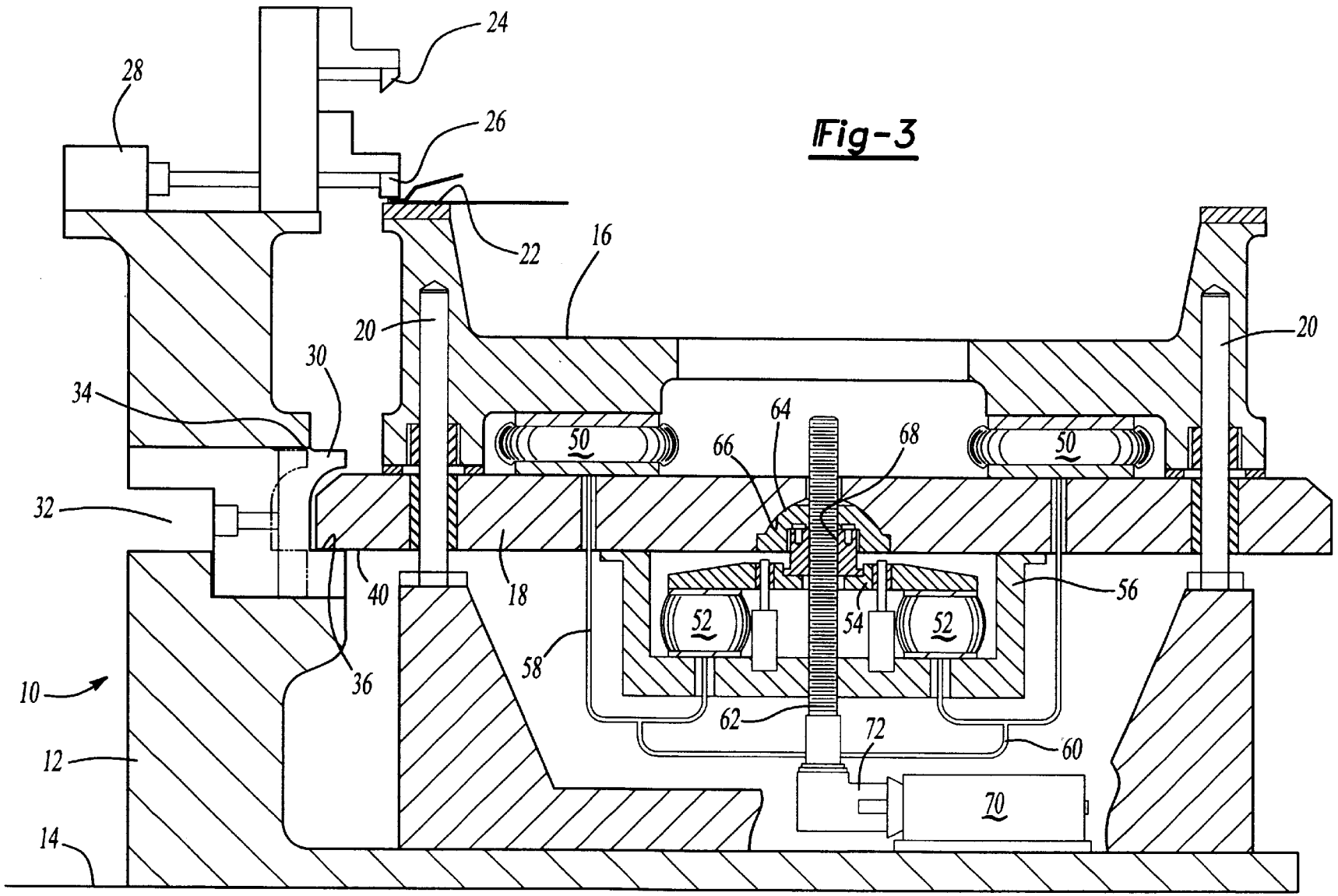
FIG. 3 is a view similar to FIG. 1, but illustrating the preferred embodiment of the invention at the initial stage of the final hem operation.

With reference now to FIGS. 1 and 3, a lock unit 30 is laterally slidably mounted to the base 12 and movable between an extended position, illustrated in solid line in FIG. 1, and a retracted position, illustrated in phantom line in FIG. 1. Any conventional means, such as a pneumatic or electric cylinder 32, may be used to selectively move the lock unit(s) 30 between its extended position and its retracted position.

The lock unit 30 includes both an upper abutment surface 34 as well as a lower abutment surface 36. These abutment surfaces 34 and 36, furthermore, are spaced apart from each other by substantially the same distance as the vertical spacing between the dies 24 and 26. Thus, with the nest carrier 18 and nest 16 in the upper position illustrated in FIG. 1 such that the nest surface 22 is positioned just below the prehem die 24, when the lock unit 30 is moved to its extended position, a lower surface 40 of the nest carrier abuts against the upper abutment surface 34 of the lock unit 30. Consequently, in this position the lock unit 30 prevents downward movement of the nest carrier 18 relative to the base 12 when later on in the cycle, the drive will be activated downward.

Similarly, as best shown in FIG. 3, with the nest carrier 18 in its lower position such that the nest surface 22 is positioned below the final hem die 26, extension of the lock unit 30 to its extended position causes the lower surface 40 of the nest carrier 18 to abut against the lower abutment surface 36 thus locking the nest carrier 18 against further downward movement.

Figure 2:
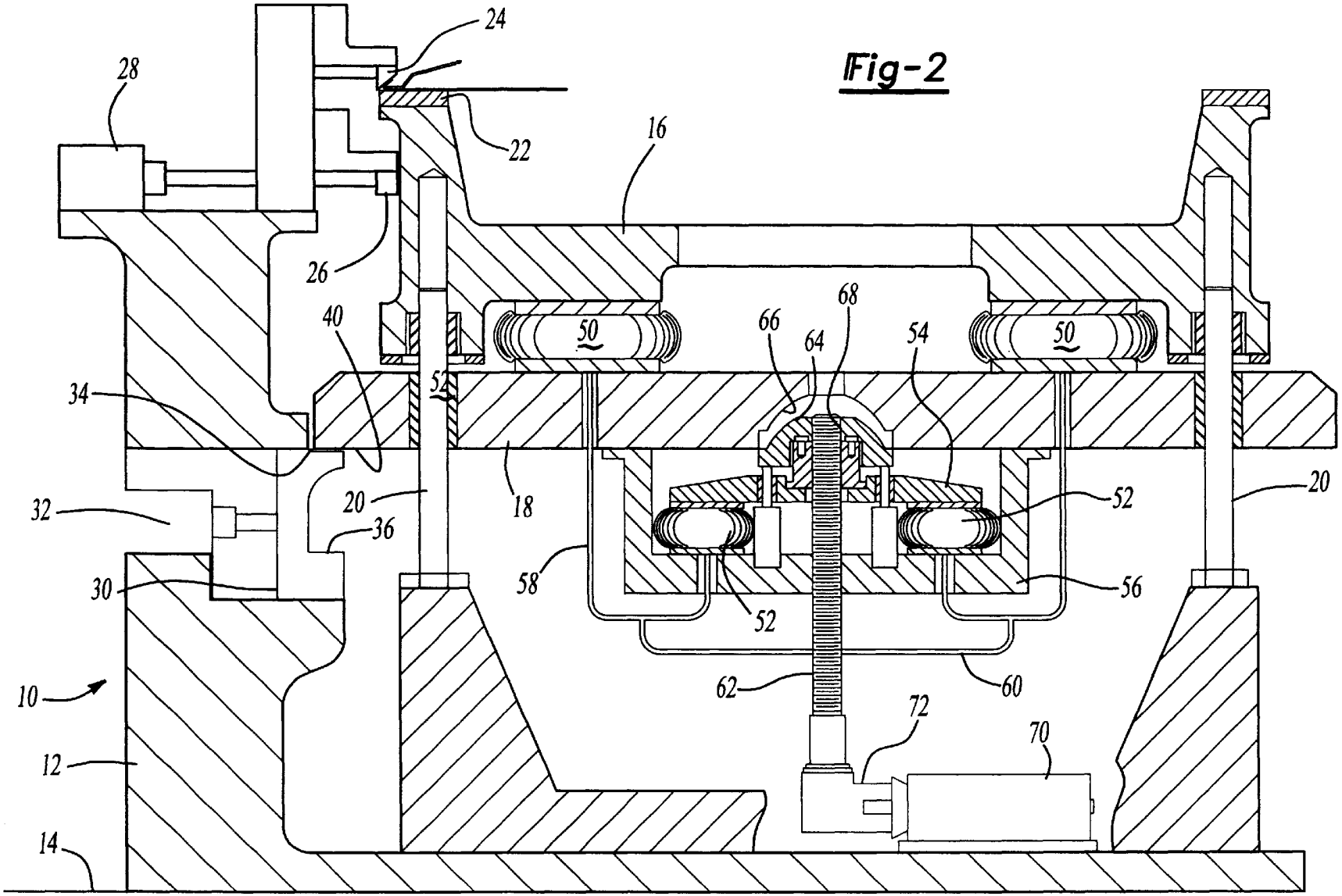
FIG. 2 is a view similar to FIG. 1, but illustrating the final stage of the prehemming operation.

With reference now to FIGS. 1 and 2, in order to vertically displace the nest 16 upwardly relative to the nest carrier 18, at least one driven hydraulic bladder 50 is sandwiched in between the nest carrier 18 and nest 16. Inflation of the driven bladder 50 thus vertically displaces the nest 16 from a lower position relative to the nest carrier 18 as shown in FIG. 1, to an upper position as shown in FIG. 2. In its upper position (FIG. 2) the part carried by the nest surface 22 is compressed against the prehem die 24 to form the prehem. Similarly, assuming that the nest carrier 18 is in its lower position as shown in FIG. 3, inflation of the driven bladder 50 would likewise displace the nest 16 vertically upwardly against the final die 26 to perform the final hem.

In order to inflate the driven bladders 50, at least one drive bladder 52 is sandwiched in between a piston 54 and a portion 56 of the nest carrier 18. The drive bladder(s) 52 is fluidly connected by fluid lines 58 to the driven bladders 50 while a pressure equalization line 60 ensures equal pressure distribution between the bladders 52 and 50 at the far end of the stroke.

The bladders 50 and 52 are filled with an incompressible fluid, such as water with an anti-corrosion additive.

Still referring to FIGS. 1 and 2, the piston 54 includes a spherical thrust bearing 64 which abuts against a recess 66 of complementary shape formed in the bottom of the nest carrier 18. Furthermore, a threaded shaft 62 engages an internally threaded bore 68 in the piston 54 so that the piston 54 moves in unison with rotation of the shaft 62. Any conventional means, such as an electric or pneumatic motor 70, is utilized to rotatably drive the shaft 62 through the appropriate gearbox 72 and thus vertically displace the piston 54.

With reference now to FIGS. 1 and 3, assuming the lock unit 30 is in its retracted position, rotation of the shaft 62 by the motor 70 moves the nest carrier 18 and nest 16 in unison with each other between its upper position (FIG. 1) and its lower position (FIG. 3). Assuming that the nest carrier 18 is in its upper position (FIG. 1) and the lock unit 30 is moved to its extended position, the lock unit 30 prevents downward movement of the nest carrier 18 and positions the part supported on the nest surface 22 in preparation for a prehem operation.

As best shown in FIG. 2, rotation of the shaft 62 in the opposite rotational direction retracts the piston 54 downwardly thus compressing the drive bladders 52 between the piston 54 and nest carrier portion 56. In doing so, the piston 54 compresses the drive bladders 52 thus pumping hydraulic fluid from the drive bladders 52 through the fluid lines 58 and to the driven bladders 50 thereby inflating the bladders 50 as shown in FIG. 2. Inflation of the drive bladders 50 vertically displaces the nest 16 upwardly relative to the nest carrier 18 thus causing the part carried by the nest surface 22 to be compressed against the prehem die 24 with an amplified force to form the prehem on the part. A surface ratio of 1:4 to 1:8 is used between drive and driven bladder to amplify the force developed by the drive to the nest by a factor of 4 to 8.

The rotational direction of the shaft 62 is then reversed thus returning the piston to the position shown in FIG. 1. Thereafter, both the die sets 24 and 26 are moved to their retracted position and the lock unit 30 is also moved to its retracted position. Rotation of the shaft 62 in the opposite direction lowers both the nest carrier 18 and nest 16 to their lower position illustrated in FIG. 3. In its lower position, the dies 24 and 26 are again moved to their extended position and the lock unit 30 is also moved to its extended position thus locking the nest carrier 18 against further downward movement. Rotation of the shaft 62 in the opposite direction then again compresses the drive bladders 52 between the piston 54 and nest carrier portion 56 in the previously described fashion thus again inflating the driven bladders 50 and displacing the nest 16 vertically upwardly relative to the nest carrier 18 to perform the final hem operation with an amplified force. The lock unit 30 and dies 24 and 26 are then moved to their retracted positions and the shaft rotated in the opposite direction to return the nest carrier 18 and nest 16 to its upper position (FIG. 1).

From the foregoing, it can be seen that the present invention provides a hemming machine which utilizes a single drive to perform all movements of the nest necessary for the hemming operation. Having described my invention, however, many modifications thereto will become apparent to those skilled in the art to which it pertains without deviation from the spirit of the invention as defined by the scope of the appended claims.

What is claimed is:

1. A hemming machine comprising:

a base, a nest, a nest carrier which supports and is slidably mounted relative to said nest, means for vertically slidably mounting said nest and said nest carrier to said base, at least one hemming die, means for laterally slidably mounting said hemming die between an extended position in which said die overlies a portion of said nest, and a retracted position in which said die is laterally spaced from the nest, means for selectively moving said at least one die between said extended and said retracted position, and means for selectively hydraulically vertically displacing said nest relative to said nest carrier wherein said hydraulic displacing means comprises at least one driven bladder sandwiched between said nest and said nest carrier, a piston, at least one drive bladder sandwiched between said piston and said nest carrier, and means for fluidly connecting said at least one drive bladder to said at least one driven bladder.

2. The invention as defined in claim 1 wherein said hydraulic displacing means comprises at least one driven bladder sandwiched between said nest and said nest carrier, a piston, at least one drive bladder sandwiched between said piston and said nest carrier, and means for fluidly connecting said at least one drive bladder to said at least driven bladder.

3. The invention as defined in claim 2 wherein said hydraulic displacing means comprises means for vertically moving said nest and said nest carrier, said vertical moving means being mechanically connected to said piston for selectively moving said piston relative to said nest carrier.

4. The invention as defined in claim 3 wherein said displacing means comprises a threaded shaft rotatably mounted to said base, said shaft engaging a threaded bore in said piston, said piston abutting against a lower surface of said nest carrier, and means for rotatably driving said shaft.

5. The invention as defined in claim 4 and comprising at least one lock unit laterally slidably mounted to said base between a retracted position in which said lock unit is spaced laterally outwardly from said nest carrier, and an extended position in which said lock unit abuts against said nest carrier and prevents downward vertical movement of said nest carrier relative to said base at at least one predetermined vertical position of said nest carrier relative to said base.

6. The invention as defined in claim 5 wherein said lock unit abuts against said nest carrier and prevents downward vertical movement of said nest carrier relative to said base at at least two predetermined vertical positions of said nest carrier relative to said base.

7. The invention as defined in claim 4 wherein said at least one drive bladder is positioned between a lower surface of said piston and said nest carrier.

8. The invention as defined in claim 6 wherein said at least one die comprises at least one prehem die and at least one final hem die, said prehem and final hem dies being vertically spaced apart by a preset distance, and wherein said at least two predetermined distances are vertically spaced apart from each other by said preset distance.

9. The invention as defined in claim 4 wherein said means for rotatably driving said shaft comprises an electric motor.

10. The invention as defined in claim 2 wherein said at least on drive bladder comprises at least two drive bladders, and means for fluidly connecting said drive bladders together.

11. The invention as defined in claim 4 wherein said nest includes a rounded recess in said lower surface of said nest, and wherein said piston includes an upper surface complementary in shape to said recess.

12. The invention as defined in claim 2 in which the surface area of said drive bladder is greater than the surface area of said driven bladder.

13. The invention as defined in claim 12 wherein the ratio of said drive bladder surface area to said driven bladder surface area forms the force amplification factor of said hydraulic displacing means.

14. The invention as defined in claim 2 wherein said drive and driven bladders are filled with an incompressible fluid.

15. The invention as defined in claim 14 wherein said incompressible fluid comprises water.

16. The invention as defined in claim 15 wherein said incompressible fluid includes an anti-corrosion additive.

* * * * *